US008656599B2

(12) United States Patent
Anderegg et al.

(10) Patent No.: US 8,656,599 B2
(45) Date of Patent: Feb. 25, 2014

(54) CUTTING TOOL

(75) Inventors: Daniel Anderegg, Gerlafingen (CH); Roger Anderegg, Berken (CH)

(73) Assignee: Marietta Anderegg, Niederbipp (CH)

( * ) Notice: Subject to any disclaimer, the term of this patent is extended or adjusted under 35 U.S.C. 154(b) by 182 days.

(21) Appl. No.: 13/393,731

(22) PCT Filed: Aug. 17, 2010

(86) PCT No.: PCT/EP2010/061969

§ 371 (c)(1),
(2), (4) Date: Mar. 1, 2012

(87) PCT Pub. No.: WO2011/026729

PCT Pub. Date: Mar. 10, 2011

(65) Prior Publication Data

US 2012/0227272 A1 Sep. 13, 2012

(30) Foreign Application Priority Data

Sep. 1, 2009 (EP) ..... 09169165
Sep. 14, 2009 (EP) ..... 09170205

(51) Int. Cl.
*B67B 7/46* (2006.01)

(52) U.S. Cl.
USPC ..... 30/410

(58) Field of Classification Search
USPC ..... 30/410, 422, 427, 424, 425, 417, 418, 30/430, 421, 416, 433, 434, 435, 436, 30/400; 294/65.5, 27.1, 16; 210/464, 514
See application file for complete search history.

(56) References Cited

U.S. PATENT DOCUMENTS

| | | | | |
|---|---|---|---|---|
| 1,789,729 | A | 1/1931 | Coyle | |
| 2,095,660 | A | 10/1937 | Dooley | |
| 3,111,995 | A * | 11/1963 | Dahl | 172/18 |
| 3,171,200 | A * | 3/1965 | Poppenga | 30/130 |
| 3,786,564 | A * | 1/1974 | Acheson | 30/124 |
| 3,821,850 | A * | 7/1974 | Kowalyk | 30/410 |
| 3,874,078 | A * | 4/1975 | Raque | 30/445 |
| 5,429,022 | A * | 7/1995 | Nakayama | 83/152 |
| 5,461,788 | A * | 10/1995 | Taylor | 30/300 |
| 6,854,524 | B1 * | 2/2005 | Williams | 172/13 |

FOREIGN PATENT DOCUMENTS

| | | |
|---|---|---|
| GB | 2 071 600 | 9/1981 |
| GB | 2 305 655 | 4/1997 |
| WO | 93 24405 | 12/1993 |

OTHER PUBLICATIONS

International Search Report issued on Nov. 26, 2010 in PCT/EP10/061969 filed on Aug. 17, 2010.

* cited by examiner

*Primary Examiner* — Ghassem Alie
(74) *Attorney, Agent, or Firm* — Oblon, Spivak, McClelland, Maier & Neustadt, L.L.P.

(57) ABSTRACT

A cutting tool for cutting out a thin-walled wall section from a container and for receiving the cut-out wall section in the cutting tool. The cutting tool can be used to cut thin-walled container walls of sheet metal or polymer.

15 Claims, 6 Drawing Sheets

Detail Z
Fig. 3
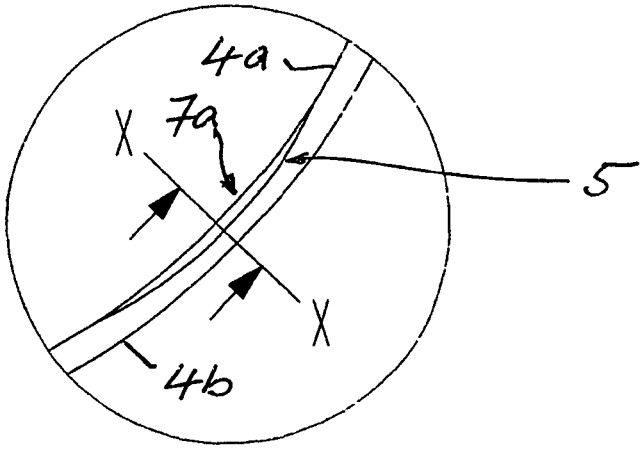
Fig. 4
Fig. 5
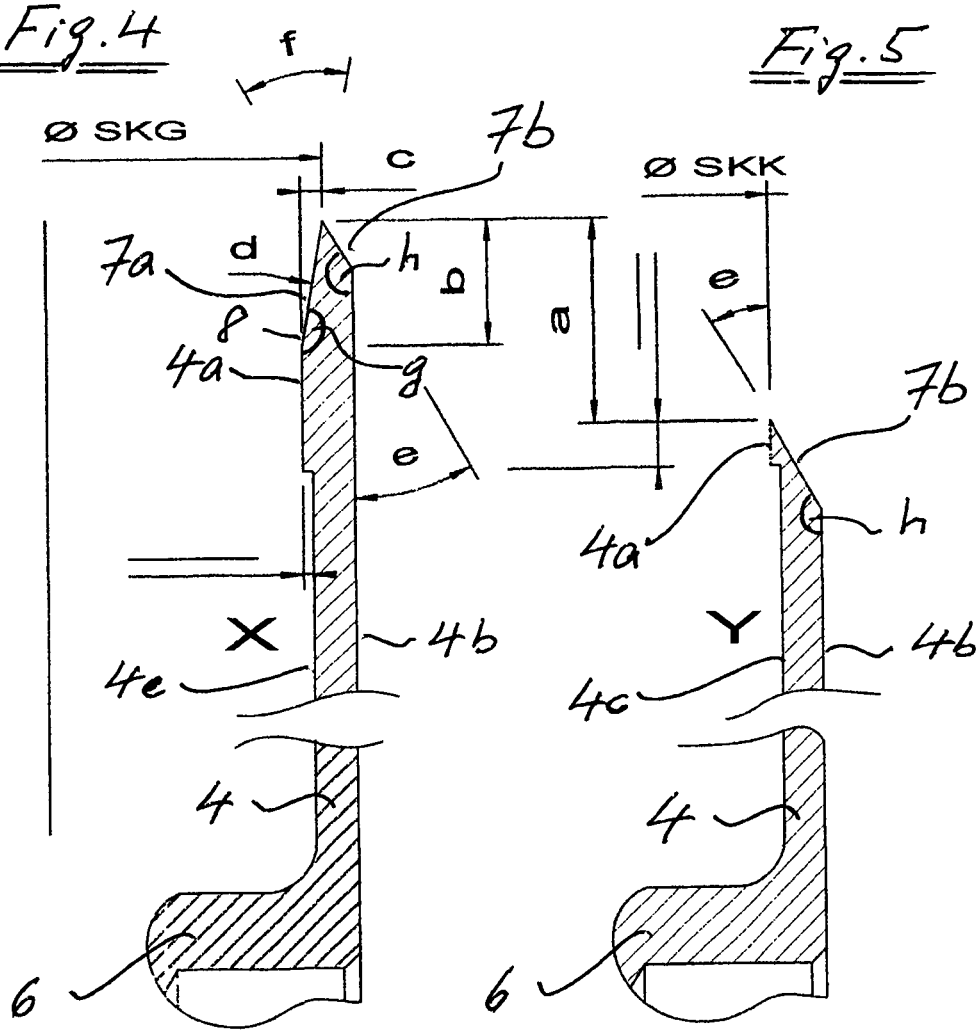

CUTTING TOOL

The invention relates to a cutting tool for cutting out a sheet-like section from a sheet-like structure, in particular a thin-walled wall section from a container, and for receiving the sheet-like section or respectively the cut-out wall section in the cutting tool.

Such cutting tools are known. They are used e.g. for opening cans of food or beverage cans. Usually the front face is thereby cut out of an e.g. cylindrical can of food or beverage can by the cutting tool, a portion of the can wall being partially or completely cut out. When cut out only partially, the cut-out section of the can wall can be bent into the can or bent out of it in order to create a sufficiently large opening in the can.

When completely cut out, the cut-out part should be prevented from falling into the can and its contents, above all for hygienic reasons. For this purpose there are cutting tools in the form of a cylindrical wall in which one of the front edges is sharpened as cutting blade. When such a cutting tool with its cutting blade is pressed against a can wall, with sufficiently sharp cutting blade and/or sufficiently great pressing of the cutting blade against the can wall, the portion of the can wall can be cut out usually without any problem. In contrast, problems arise again and again during receiving of the cut-out portion of the can wall in the cutting tool. When the surface of the inner wall of the cylindrical cutting tool is a smooth, purely cylindrical surface, it can occur during subsequently carried out cutting out of wall sections of identical cans that the cut-out portion of the can wall becomes stuck in the interior of the cylinder, or that the cut-out portion of the can falls out of the interior of the cylinder and into the can. Since only very small differences in the dimensions of the cut-out portion and/or in the geometry of the receiving cylinder are responsible for the difference between a section falling out and a section being moderately lodged-in, i.e. a section being easily removable from the cutting tool, no satisfactory results have been able to be obtained so far with reproducible cutting out and lodging of the can wall section.

There have been attempts to obtain a reliable result with barbed hooks on the cutting tool inner face, i.e. on the inner cylinder wall. This, too, did not lead to any reproducible cutting and lodging. Instead such cutting tools tended above all to form metal cuttings or swarf when cutting out tin cans and lodging of the cut-out portions, which metal cuttings or swarf can end up in the can. This is unacceptable both with cans for food as well as beverage cans.

The object of the invention is to provide a cutting tool of the initially described type which functions in a reproducible way and with which practically no cuttings or swarf, in particular no metal cuttings or swarf, arise.

To achieve the object of the invention, the invention provides a cutting tool for cutting out a sheet-like section from a sheet-like structure, in particular a thin-walled wall section of a container, and for receiving the sheet-like section or respectively the cut-out wall section in the cutting tool. The cutting tool is formed by a basic body. This basic body has at least in one portion a prism-shaped hollow body with a prism-shaped jacket wall, whose front edge is configured as a cutting edge extending continuously along the entire circumferential direction of the prism-shaped hollow body and surrounding the front opening of the hollow body. The basic body further comprises a connecting region for connecting the basic body to a drive means. The front edge, configured as cutting edge, of the prism-shaped jacket wall has along the circumferential direction a course with different positions in axial direction of the prism-shaped hollow body. According to the invention, the front edge provided with the cutting edge has at least in two cutting edge-circumferential regions one protruding cutting edge section each, protruding along the axial direction, on the inner face of which section the prism-shaped jacket wall inner surface has a recess, which is adjacent to the respective protruding cutting edge section of the cutting edge.

In a cutting edge region adjacent to such a recess, the projection of the cutting edge course has a bulge or respectively an "ear" on a plane orthogonal to the axial direction, such as e.g. the plane of the sheet-like structure. When cutting out a section from a sheet-like structure, a bulge is created on the cut-out sheet-like section, which bulge corresponds to the bulge in the said projection of the cutting edge course.

Based on the at least two cutting edge sections protruding in axial direction, with one recess each adjacent to this cutting edge section, in the jacket wall inner surface, a section with two bulges is obtained when cutting out the section from the sheet-like structure.

It generally applies that there where the recess of the jacket wall inner surface is adjacent to the cutting edge, the course of the projection of the cutting edge as well as the contour of the sheet-like section cut out with such a cutting edge have a bulge. On these bulges or respectively "ears", of which the cut-out sheet-like section according to the invention has two, the section is firmly clamped inside the hollow body on the prism-shaped jacket wall, which wall adjoins the protruding cutting edge sections. The sheet-like sections or respectively wall sections firmly clamped by means of such bulges are clamped firmly enough to prevent their uncontrolled falling out of the prism-shaped hollow body. On the other hand, they are not clamped so firmly that one would have to exert large amounts of pushing force to push them out.

To produce the cutting tool according to the invention, one can start with a prism-shaped hollow body, which forms the basic body of the cutting tool. Then, in a first step, one can give the front edge, which runs around the front opening of this hollow body, a cutting edge course along the circumferential direction, e.g. by grinding and sharpening, which course has different axial positions, i.e. axially protruding cutting edge sections along the axial direction of the prism-shaped hollow body. In a second step, the recesses in the jacket wall inner surface can be made in the regions of the protruding cutting edge sections. At the places where the recesses meet the cutting edge, bulges arise in the projection of the cutting edge course. The two steps can also be carried out in reverse order. After the recesses in the jacket wall inner surface of the basic body have been produced in a first step, the grinding and sharpening follow in a second step, whereby one sees to it that the cutting edge produced crosses the recesses. At the places where the cutting edge crosses the recesses, bulges occur in the projection of the cutting edge course.

In a special embodiment, the cutting edge has at least in two circumferential regions in axial direction one protruding section each, in which section the jacket wall inner surface has a slanted course along the axial direction all the way to the cutting edge, whereby the radial spacing measured from a longitudinal axis of the prism-shaped hollow body to the jacket wall inner surface increases along the axial direction toward the cutting edge.

This has the effect that, with first, simultaneous impingement of the protruding sections of the cutting edge on a (practically even) thin-walled wall section of a container, the first cut or puncture takes place at points which lie further out in relation to the cut-out portion of the container wall. If the cutting edge now penetrates somewhat deeper into the container wall, the radial spacing measured from the longitudinal axis of the penetrating prism-shaped hollow body to the jacket wall inner surface decreases along the axial direction toward the cutting edge. This decrease in the radial spacing between the cutting edge and the longitudinal axis of the prism-shaped hollow body takes place at least in two circumferential regions in which the sections protruding in axial direction, so-called pre-cutter or respectively leading edges, are disposed. This increasing reduction of the cross-sectional area in the interior of the prism-shaped hollow body during penetration of the cutting edge in the container wall brings about a defined deformation of the cut-out wall section on the inner wall of the prism-shaped hollow body and also possibly a compression of the cut-out wall section while it is being cut out. The cut-out wall section is thereby firmly clamped in the interior of the prism-shaped hollow body in a reproducible way.

The cutting tool according to the invention is suitable for cutting thin metal (sheet metal), in particular aluminum, and for cutting thin polymer material (foil, web material, thin plates), in particular polyethylene terephthalate (PET), polybutylene terephthalate (PBT), cellulose-based material such as paper or cardboard, but also starch-based material such as flatly rolled or pressed foodstuffs.

For cutting thin polymer material, it is advantageous if the cutting tool is heated. A cutting tool temperature optimal for the cutting can be set, depending on the polymer material.

Preferably the jacket wall inner surface of the cutting tool has the course slanted toward the cutting edge only in the circumferential regions with the respective protruding cutting edge sections. The slanted course of the jacket wall inner surface is formed by a planar grinding or by a curved grinding.

Like the jacket wall inner surface, the jacket wall outer surface preferably also has a slanted course along the axial direction all the way to the cutting edge, whereby the radial spacing measured from the longitudinal axis of the prism-shaped hollow body to the jacket wall outer surface decreases along the axial direction toward the cutting edge.

Preferably the circumferential regions with the sections protruding in axial direction are evenly distributed along the circumferential direction.

The prism-shaped hollow body can have a circular, an oval or a polygonal cross section.

A cylindrical cutting tool with circular cross section can be produced in an especially simple way. The recesses can be produced e.g. by grinding an annular groove on the cylindrical jacket wall inner surface. Afterwards the bulges can be produced in the projection of the cutting edge course in that during grinding and sharpening of the cylinder wall front edge one crosses the previously produced annular groove. The sequence of the two steps here can also be inverted.

The prism-shaped jacket wall is advantageously made of steel, ceramic material or hard metal at least in the region of its cutting edge.

In an especially advantageous embodiment, the axial length (b) of the region with the recess on the jacket wall inner surface at the protruding sections is smaller than the maximal difference (a) of the different axial positions of the cutting edge along the circumferential direction.

In another advantageous embodiment, the jacket wall inner surface of the prism-shaped hollow body has a microscopically rough surface and/or macroscopic protrusions at least in an axial portion of the inner surface.

Preferably the surface profile of the jacket wall inner surface (4*a*) and the surface profile of the jacket wall inner <sic. outer> surface (4*b*) along the axial direction has blunt edges (8) of at least 120° or respectively changes in direction of the surface tangent (d or respectively e) of at most 60°.

Preferably the cutting tool has a push rod which extends through a push rod opening of the basic body and/or is borne therein, and which is movable back and forth axially in the interior of the prism-shaped hollow body, so that cut-out wall sections obtained in the interior of the hollow body are able to be ejected out of the hollow body.

It is especially advantageous if the cutting tool has, in addition to the front opening, an exit opening, so that cut-out wall sections received and, if applicable, stacked beforehand in the interior of the prism-shaped hollow body are able to be ejected by means of cut-out wall sections coming afterwards in the hollow body.

Alternatively, a suction device can be connected to the exit opening so that cut-out wall sections obtained inside the hollow body can be suctioned out of the hollow body.

The connecting region of the cutting tool can have a handle. In particular, the cutting tool can have a pliers-type or clamp-type holding device, on the first arm of which the basic body having the cutting edge is attached by means of its connecting region, and on the second arm of which the container having the thin wall section is firmly attachable, so that through a relative movement of the two arms the cutting edge can be pushed against the thin-walled wall section and through this section.

The prism-shaped hollow body can have in a portion of its inner wall an expanded cross section along its axial direction. Cut-out sections can be loosely stacked in this axial region of the hollow body, so that the ejection of the sections collected in the hollow body can take place without great application of force after a certain number of opening or respectively cutting operations.

Further advantages, features and application possibilities of the invention become apparent from the description which now follows of preferred embodiment examples of the cutting tool according to the invention, with reference to the drawing, whereby:

FIG. 3 shows an enlarged view of a detail of the cutting tool according to the invention in the encircled region Z of FIG. 1;

FIG. 4 is a view of the cutting tool according to the invention along the sectional plane X-X of FIG. 1;

FIG. 5 is a view of the cutting tool according to the invention along the sectional plane Y-Y of FIG. 1;

Figure 1:
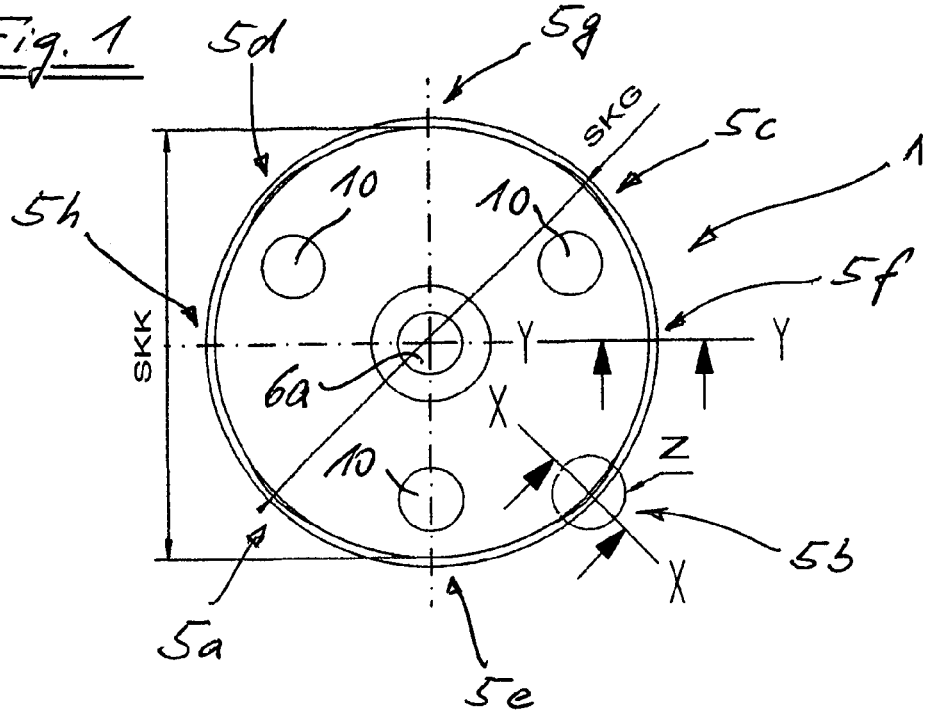
FIG. 1 shows a view from above of a first embodiment of the cutting tool according to the invention along its longitudinal axis L.

Shown in FIG. 1 is a view from above of a first embodiment example of the cutting tool 1 according to the invention along its longitudinal axis L. The cutting tool 1 serves to cut out a thin-walled wall section from a container, such as e.g. a beverage can (not shown), and to receive the cut-out wall section in the cutting tool 1. For this purpose the cutting tool 1 has along its cutting edge 5 four protruding sections 5*a*, 5*b*, 5*c* and 5*d* as well as four set-back sections 5*e*, 5*f*, 5*g* and 5*h* (see also FIG. 2). Moreover a central hole 6*a* is provided on the connecting region 6 (see in FIG. 2), by means of which the cutting tool 1 is able to be connected to a drive means (not shown).

Figure 2:
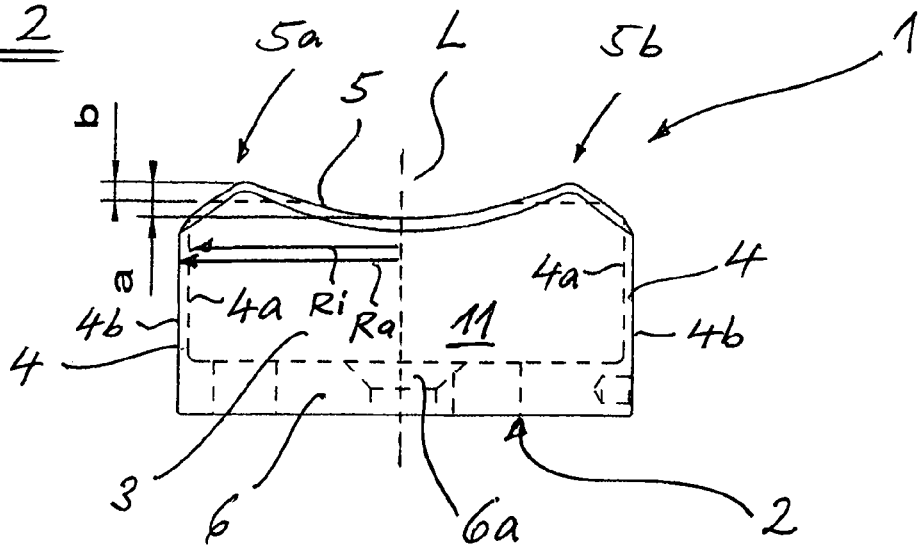
FIG. 2 shows a lateral view of the embodiment example of FIG. 1 transversely to its longitudinal axis L.

In FIG. 2, a lateral view of the embodiment example of FIG. 1 is shown transversely to its longitudinal axis L. The cutting tool 1 is formed by a basic body 2, which has in one portion a prism-shaped hollow body 3. This hollow body 3 is formed by a prism-shaped jacket wall 4, whose front edge 5 is configured as a cutting edge 5 extending along the circumferential direction of the prism-shaped hollow body 3 and surrounding the front opening thereof, which cutting edge points upward in FIG. 2. At its end pointing downward in FIG. 2 the basic body 2 has its connecting region 6 with the hole 6*a*, by means of which it can be connected to the drive means (not shown). The drive means can be a hand-operated machine having a lever in which machine the cutting tool is able to be moved up and down by muscle force via a leverage. A can, e.g. a beverage can, can be fixed in the machine.

The cutting edge 5 has along its circumferential direction a course with different positions in axial direction of the prism-shaped hollow body 3. In the present example, cutting edge 5 has in four circumferential regions in axial direction protruding sections 5*a*, 5*b*, 5*c* and 5*d* (see FIG. 1), of which only the two sections 5*a* and 5*b* are visible in FIG. 2. In these protruding sections 5*a*, 5*b*, 5*c* and 5*d*, which serve as "precutter" or respectively "wide cutter", the jacket wall-inner surface 4*a* has a slanted course 7*a* (see FIG. 3) along the axial direction all the way to the cutting edge 5. With this slanted course, the radial spacing Ri measured from the longitudinal axis L of the prism-shaped hollow body 3 increases from the longitudinal axis L to the jacket wall inner surface 4*a* along the axial direction toward the cutting edge 5.

Between its protruding sections 5*a*, 5*b*, 5*c* and 5*d* the cutting edge 5 has set-back sections 5*e*, 5*f*, 5*g* and 5*h* (see FIG. 1), of which only the sections 5*e*, 5*f* and 5*h* are visible in FIG. 2. In these sections 5*e*, 5*f*, 5*g* and 5*h*, which serve as "post-cutter", the jacket wall-inner surface 4*a* has no slanted course 7*a* (see FIG. 3). Here the radial spacing Ri measured from the longitudinal axis L of the prism-shaped hollow body 3 is constant from the longitudinal axis L to the jacket wall-inner surface 4*a* along the axial direction.

Thus with downward movement of the cutting tool 1 against a can, the lid can be cut open on the can front face and ultimately cut out. At the protruding sections 5*a*, 5*b*, 5*c* and 5*d*, which are rounded points, the can lid is first punctured. With subsequent further penetration of the sections 5*e*, 5*f*, 5*g* and 5*h* of the cutting tool 1 into the can lid, this lid is completely cut out and is firmly clamped in the interior 11 of the hollow body 3 by the jacket wall inner surface 4*a*.

An enlarged view of a detail of the cutting tool according to the invention in the encircled region Z of FIG. 1 is shown in FIG. 3. On the jacket wall inner surface 4*a* a slanted course 7*a* can be discerned in the form of a slanted sharpening on the cutting edge 5. This slanted course 7*a* is only made on the regions with the protruding sections or respectively rounded tips 5*a*, 5*b*, 5*c* and 5*d* of the jacket wall inner surface 4*a*. In the remaining areas along the circumferential direction of the cutting edge 5, the jacket wall inner surface 4*a* has no slanted course 7*a*.

Shown in FIG. 4 is a view of the cutting tool 1 according to the invention along the sectional plane X-X of FIG. 1, and shown in FIG. 5 is a view of the cutting tool according to the invention along the sectional plane Y-Y of FIG. 1. The acute angle f is in the range of 5° to 90°, preferably in the range of 10° to 60° and most preferably in the range of 25° to 45°. The acute angle f is the angle at the cutting edge 5 tapering to a point between the slant 7*a* on the jacket wall inner surface 4*a* and the slant 7*b* on the jacket wall outer surface 4*b*. The slant 7*a* forms an angle d to the longitudinal axis L. The slant 7*b* forms an angle e to the longitudinal axis L. The acute angle f is the sum of the angles d and e.

FIG. 4 shows a section through a protruding section 5*b* as one of the four protruding sections (see section X-X in FIG. 1). The cylindrical jacket wall 4 extends from the connecting region 6 to the cutting edge 5. The jacket wall inner surface 4*a* is a cylinder wall with radius Ri (see FIG. 2), and has a slanted course 7*a* only in the region of the cutting edge 5, which slanted course can be designed as planar or as conical cut. The jacket wall outer surface 4*b* is a cylinder wall with radius Ra (see FIG. 2), and likewise has a slanted course 7*b* in the region of the cutting edge 5, which slanted course is designed as conical cut and extends along the entire circumferential direction of the cutting tool 1. The protruding section 5*b* of the cutting edge 5 shown in section in FIG. 4 serves as "pre-cutter". The further three protruding sections 5*a*, 5*c* and 5*d* of the cutting edge 5 have the same function. These four pre-cutters 5*a*, 5*b*, 5*c* and 5*d* are evenly distributed along the circumferential direction of the cutting tool 1.

FIG. 5 shows a section through set-back section 5*f* as one of the four set-back sections (see section Y-Y in FIG. 1). The cylindrical jacket wall 4 extends from the connecting region 6 all the way to the cutting edge 5. The jacket wall inner surface 4*a* is a cylinder wall with radius Ri (see FIG. 2), and has no <sic. a> slanted course 7*a* only in the region of the cutting edge 5. The jacket wall outer surface 4*b* is a cylinder wall with radius Ra (see FIG. 2), and likewise has a slanted course 7*b* in the region of the cutting edge 5, which slanted course is designed as conical cut, and extends along the entire circumferential direction of the cutting tool 1. The set-back section 5*f* of the cutting edge 5 shown in section in FIG. 5 serves as "post-cutter". The further three set-back sections 5*e*, 5*g* and 5*h* of the cutting edge 5 have the same function. These four post-cutters 5*e*, 5*f*, 5*g* and 5*h* are likewise evenly distributed along the circumferential direction of the cutting tool 1.

The axial length b of the region with slanted course 7*a* on the pre-cutters 5*a*, 5*b*, 5*c* and 5*d* of the jacket wall inner surface 4*a* is smaller than the maximal axial difference a between the different protruding axial positions 5*a*, 5*b*, 5*c*, 5*d* and the different set-back axial positions 5*e*, 5*f*, 5*g*, 5*h* of the cutting edge 5 along the circumferential direction.

In the view from above of FIG. 1 and even more clearly in the enlarged view from above of FIG. 3, one can see how the cutting edge 5 extends in a serpentine way along the circular ring which is formed by the axial projection of the cylindrical jacket wall 4. In the regions 5*a*, 5*b*, 5*c* and 5*d*, which correspond to the section of FIG. 4 (pre-cutter), the cutting edge 5 runs from the inner circle, which is formed by the jacket wall inner surface 4*a*, into the interior of the surface of the circular ring projection and back again to the inner circle. In the regions lying in between 5*e*, 5*f*, 5*g* and 5*h*, which correspond to the section of FIG. 5 (post-cutter), the cutting edge 5 runs on the inner circle projection.

The obtuse angles g and h (see FIG. 4 or respectively FIG. 5) at the transitions from the cylindrical jacket wall inner surface 4*a* to the slant 7*a* or respectively from the cylindrical jacket wall outer surface 4*b* to the slant 7*b*, are each at least 120°. This corresponds to changes in direction d or respectively e of the surface tangent in the axial direction L of at most 60° or respectively an acute angle f=d+e of at most 60°.

The cutting tool 1 according to the invention is suitable for cutting a thin-walled wall section out of a can, such as e.g. an aluminum beverage can, or out of a polymer container, such as e.g. a container made of polyethylene terephthalate (PET), and for receiving the cut-out wall section in the interior 11 of the cutting tool 1.

Especially for the cylindrical geometry of the embodiment example shown, it can also be said that the large or respectively outer cutting circle SKG determined by the cutting edge positions of the pre-cutters 5*a*, 5*b*, 5*c* and 5*d* has a larger diameter at a respective tooth tip (see FIG. 4) than the small or respectively inner cutting circle SKK determined by the cutting edge positions of the post-cutters 5*e*, 5*f*, 5*g* and 5*h* at a respective tooth root surface (see FIG. 5). The difference in the diameters of the two cutting circles SKG and SKK is 2*c* (see FIG. 4).

If the cutting edge 5 now penetrates somewhat deeper into the container wall, a defined deformation takes place of the cut-out wall section on the inner wall 4*a* of the cylindrical hollow body 3 as well as, possibly also, a compression of the cut-out wall section during its cutting out. The cut-out wall section is thereby firmly clamped in a reproducible way in the interior 11 of the cylindrical hollow body 3.

In FIG. 4 and in FIG. 5 one can see on the prism-shaped hollow body 3 a portion 4*c* of its inner wall which has an expanded cross section along its axial direction. In this axial region of the hollow body 3 cut-out sections 12 (see FIG. 6) can be loosely stacked so that the ejection of the sections 12 collected in the hollow space 3 can take place without great application of force after a certain number of opening or respectively cutting-out operations.

Figure 6:
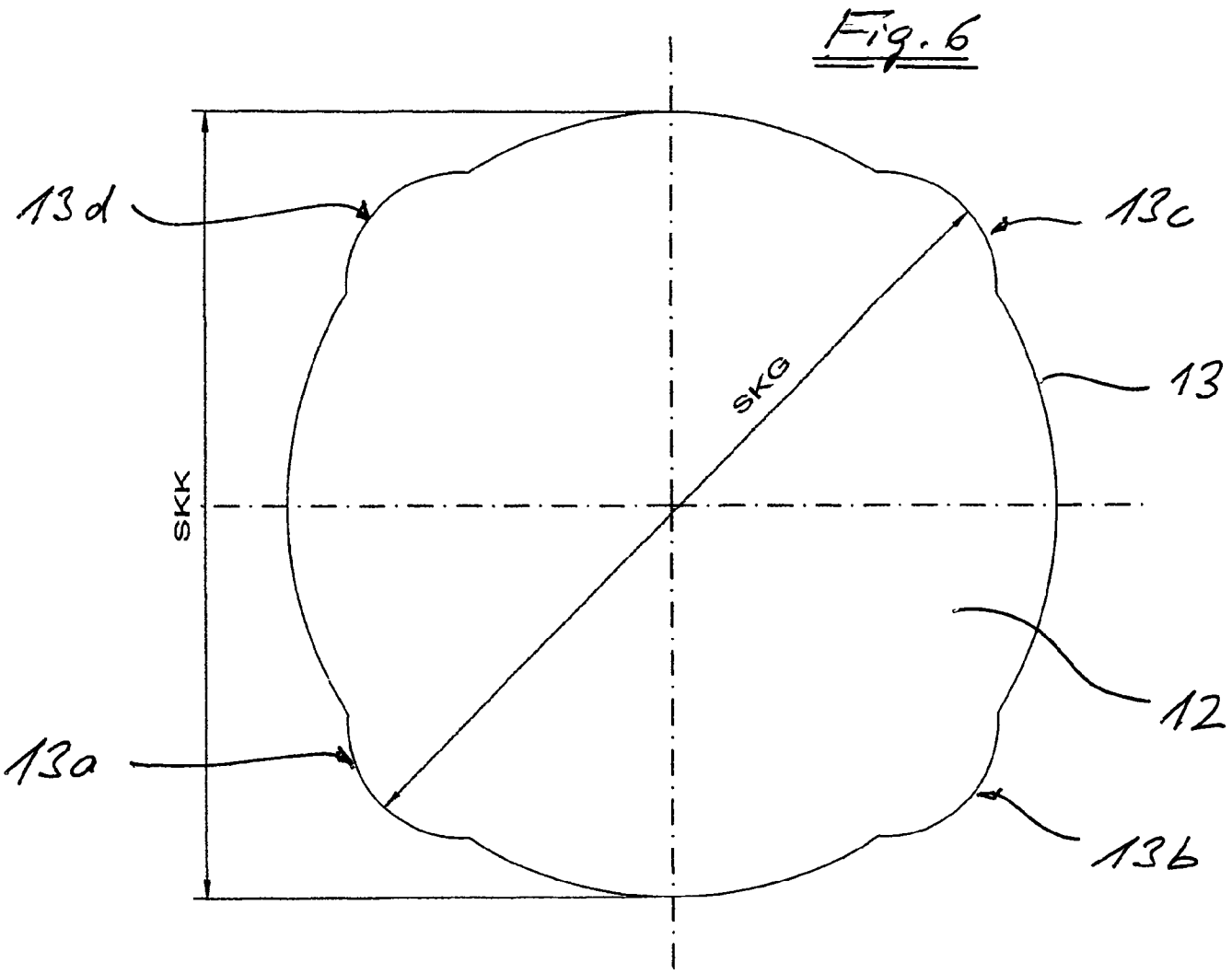
FIG. 6 shows a view from above of a cut-out sheet-like section which was produced with a cutting tool according to the first embodiment example.

Shown in FIG. 6 is a view from above of a cut-out sheet-like section 12, which was produced with a cutting tool 1 according to the first embodiment example. The outer edge 13 of the section 12 has four bulges 13*a*, 13*b*, 13*c* and 13*d* (shown exaggerated) evenly distributed along the circumferential direction, which were produced by the protruding sections 5*a*, 5*b*, 5*c* or respectively 5*d*. The course of the projection of the cutting edge 5 (see FIG. 1 and FIG. 3) corresponds to the course of the outer edge 13 of the section 12.

Figure 7:
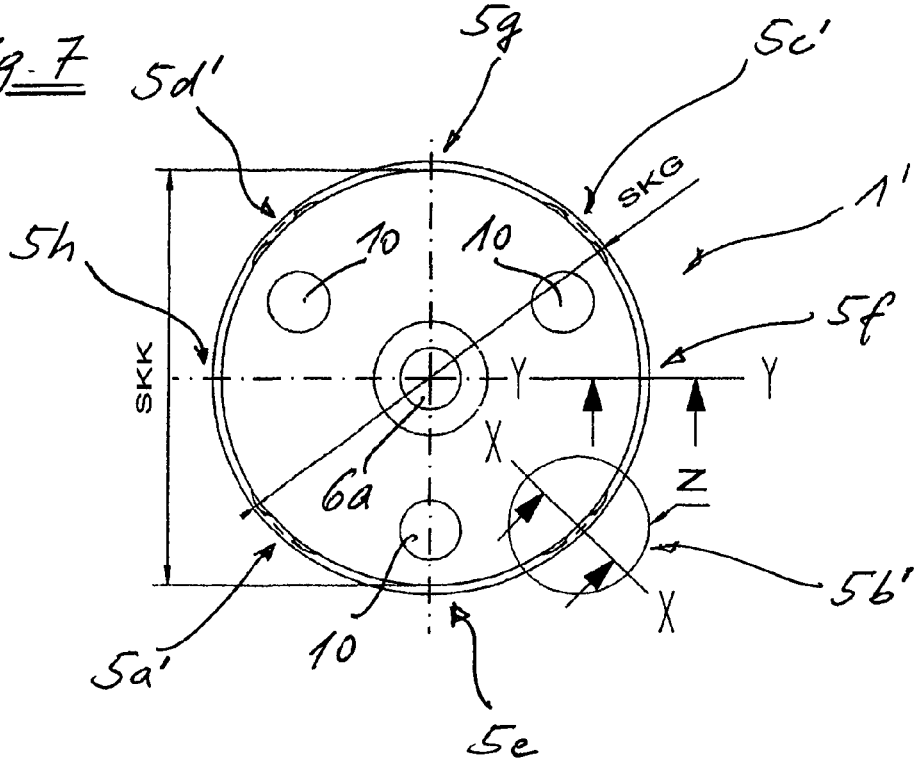
FIG. 7 shows a view from above of a second embodiment example of the cutting tool according to the invention along its longitudinal axis L.
Figure 8:
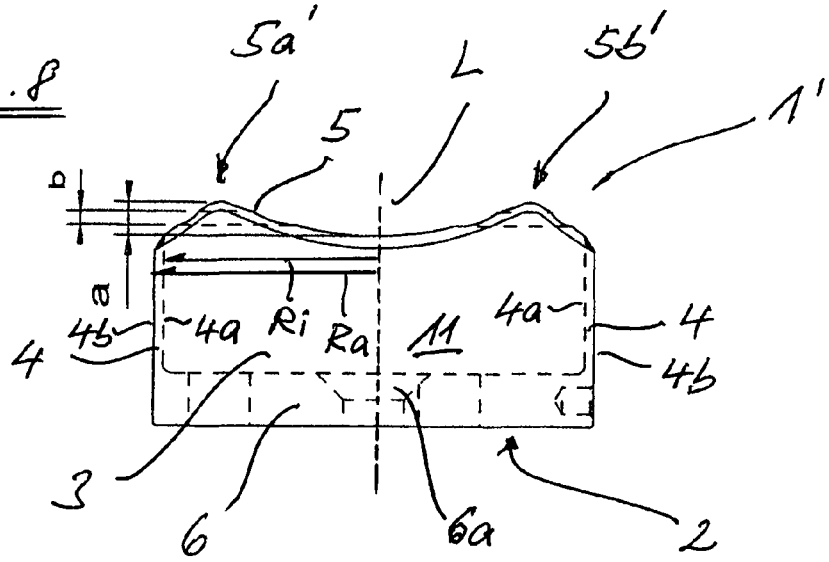
FIG. 8 shows a lateral view of the embodiment example of FIG. 7 transversely to its longitudinal axis.
Figure 9:
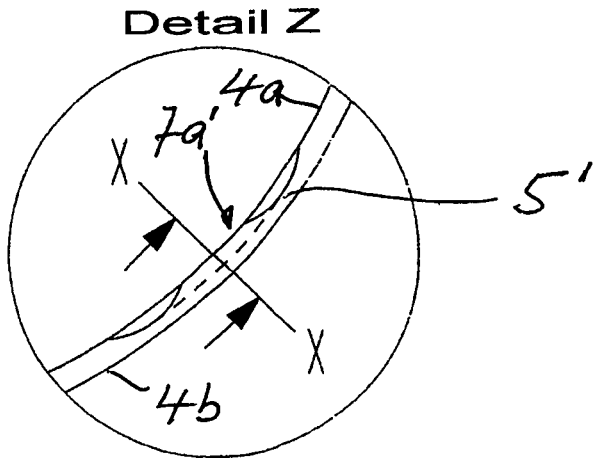
FIG. 9 shows an enlarged view of a detail of the cutting tool according to the invention in the encircled region Z of FIG. 7.
Figure 10:
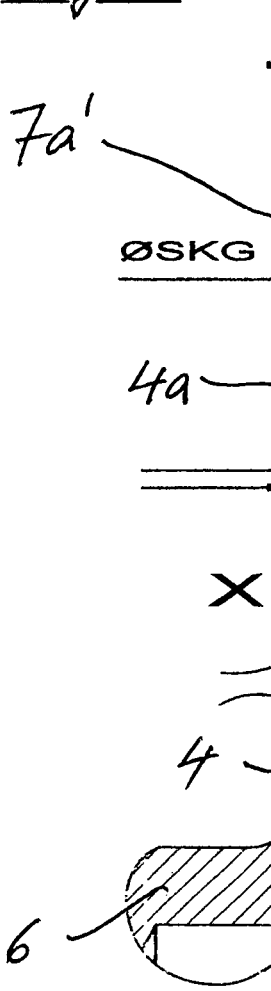
FIG. 10 is a view of the cutting tool according to the invention along the sectional plane X-X of FIG. 7.
Figure 11:
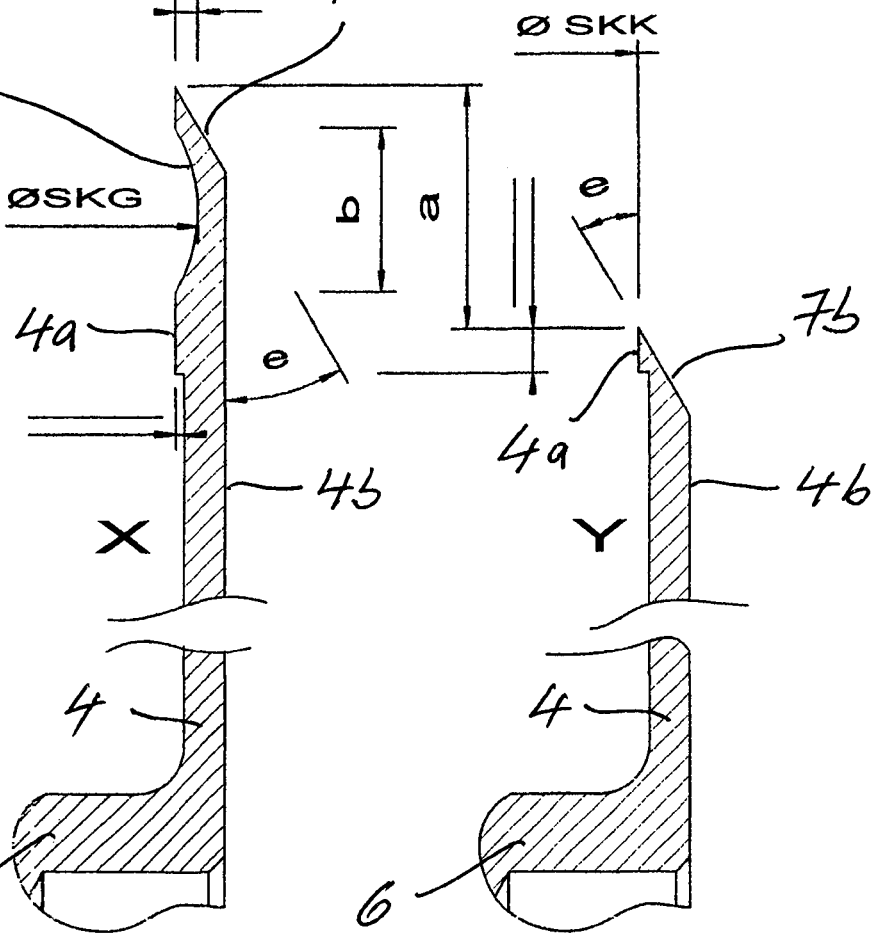
FIG. 11 is a view of the cutting tool according to the invention along the sectional plane Y-Y of FIG. 7.

Shown in FIG. 7 is a view from above of a second embodiment example of the cutting tool according to the invention along its longitudinal axis L. This second embodiment example differs from the first embodiment example in that a recess 7*a*' is provided in the form of an annular groove in the protruding sections 5*a*', 5*b*', 5*c*' and 5*d*'. This recess 7*a*' does not go all the way to the tip of the respective protruding section 5*a*', 5*b*', 5*c*' and 5*d*'. At the places where this annular groove-recess 7*a*' is cut by the cutting edge 5 (see FIG. 8), the projection of the cutting edge course has a bulge. Since the annular groove-recess 7*a*' is crossed twice by the cutting edge at each protruding section, two bulges in the cutting edge projection (see FIG. 7 and FIG. 9) result at each protruding section 5*a*', 5*b*', 5*c*' and 5*d*'.

In FIGS. 7 to 12 parts bearing the same reference numerals as in FIGS. 1 to 6 are identical to these parts.

Figure 12:
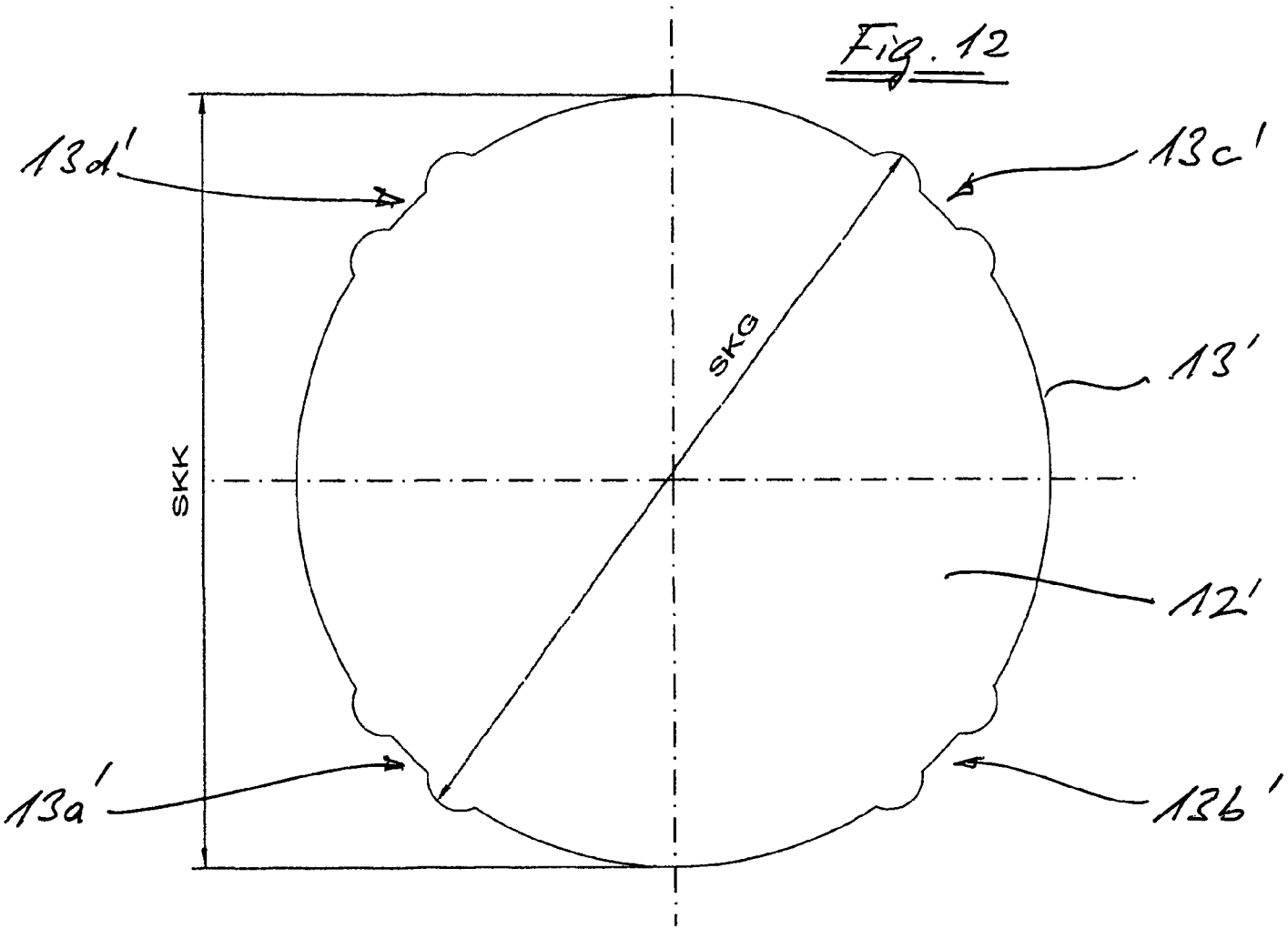
FIG. 12 shows a view from above of a cut-out sheet-like section which was produced with a cutting tool according to the second embodiment example.

Shown in FIG. 12 is a view from above of a cut-out sheet-like section 12', which was produced with a cutting tool 1' according to the second embodiment example. The outer edge 13' of the section 12' has four bulge pairs 13*a*', 13*b*', 13*c*' and 13*d*' (shown exaggerated) evenly distributed along the circumferential direction, which were produced by the protruding sections 5*a*', 5*b*', 5*c*' or respectively 5*d*'. The course of the projection of the cutting edge 5' (see FIG. 7 and FIG. 9) corresponds to the course of the outer edge 13' of the section 12'.

The invention claimed is:

1. A cutting tool for cutting out a sheet-like section from a sheet-like structure, or from a thin-walled wall section of a container, and for receiving the sheet-like section or respectively the cut-out wall section in the cutting tool, the cutting tool comprising:

a basic body, which includes at least in one portion a prism-shaped hollow body with a prism-shaped jacket wall, whose front edge is configured as a cutting edge extending along the circumferential direction of the prism-shaped hollow body and surrounding the front opening of the hollow body; and a connecting region for connecting the basic body to a drive means;

the front edge, configured as a cutting edge, of the prism-shaped jacket wall including along the circumferential direction a course with different positions in axial direction of the prism-shaped hollow body;

wherein the front edge including the cutting edge includes at least in two cutting edge-circumferential regions one protruding cutting edge section each, protruding along the axial direction, on an inner face of which section the prism-shaped jacket wall inner surface includes a recess, which is adjacent to the respective protruding cutting edge section of the cutting edge;

wherein the cutting edge extends continuously along an entire circumferential direction of the prism-shaped hollow body; and wherein an axially set-back cutting edge section, serving as post-cutter, is disposed in each case between the axially protruding cutting edge sections serving as pre-cutters;

wherein a) the jacket wall inner surface at the protruding cutting edge sections includes a slanted course along the axial direction all the way to the cutting edge, in which slanted course the radial spacing measured from a longitudinal axis of the prism-shaped hollow body increases from the longitudinal axis to the jacket wall inner surface along the axial direction to the cutting edge;

or b) the jacket wall inner surface at the protruding cutting edge sections includes a recess in a form of an annular groove, which does not border all the way to the tip of the respective protruding sections; and wherein the jacket wall inner surface at the set-back cutting edge sections has no slanted course, in which non-slanted course the radial spacing measured from the longitudinal axis of the prism-shaped hollow body is constant from the longitudinal axis to the jacket wall inner surface along the axial direction.

2. A cutting tool according to claim 1, wherein the axially protruding cutting edge sections are rounded tips.

3. A cutting tool according to claim 1, wherein in at least in two circumferential regions in the axial direction the cutting edge includes one protruding section each, in which section the jacket wall inner surface includes a slanted course along the axial direction all the way to the cutting edge, radial spacing measured from a longitudinal axis of the prism-shaped hollow body to the jacket wall inner surface increasing along the axial direction toward the cutting edge.

4. A cutting tool according to claim 3, wherein the jacket wall inner surface includes the course slanted toward the cutting edge only in the circumferential regions with the respective protruding cutting edge sections.

5. A cutting tool according to claim 3, wherein the slanted course of the jacket wall inner surface is formed by a planar grinding or by a curved grinding.

6. A cutting tool according to claim 1, wherein the jacket wall outer surface includes a slanted course along the axial direction all the way to the cutting edge, the radial spacing measured from a longitudinal axis of the prism-shaped hollow body to the jacket wall outer surface decreasing along the axial direction toward the cutting edge.

7. A cutting tool according to claim 1, wherein the circumferential regions with the sections protruding in axial direction are evenly distributed along the circumferential direction.

8. A cutting tool according to claim 1, wherein the prism-shaped hollow body has a circular, an oval, or a polygonal cross section.

9. A cutting tool according to claim 1, wherein the prism-shaped jacket wall consists of steel, of ceramic material, or of hard metal at least in the region of its cutting edge.

10. A cutting tool according to claim 1, wherein the axial length of the region with the recess on the jacket wall inner surface at the protruding sections is smaller than the maximal difference of the different axial positions of the cutting edge along the circumferential direction.

11. A cutting tool according to claim 1, wherein the jacket wall inner surface of the prism-shaped hollow body has a microscopically rough surface and/or macroscopic protrusions at least in an axial portion of the inner surface.

12. A cutting tool according to claim 1, wherein the surface profile of the jacket wall inner surface and the surface profile of the jacket wall outer surface along the axial direction has blunt edges of at least 120° or respectively changes in direction of the surface tangent of at most 60°.

13. A cutting tool according to claim 1, further comprising a push rod that extends through a push rod opening of the basic body and/or is borne therein, and which is movable back and forth axially in the interior of the prism-shaped hollow body, so that cut-out wall sections obtained in the interior of the hollow body are able to be ejected out of the hollow body.

14. A cutting tool according to claim 1, further comprising, in addition to the front opening, an exit opening, so that cut-out wall sections received and, if applicable, stacked beforehand in an interior of the prism-shaped hollow body are able to be ejected by cut-out wall sections coming afterwards in the hollow body.

15. A cutting tool according to claim 1, wherein the prism-shaped hollow body in a portion of its inner wall has an expanded cross section along its axial direction.

* * * * *